United States Patent [19]

Moreau

[11] Patent Number: 4,499,678

[45] Date of Patent: Feb. 19, 1985

[54] MECHANICAL DEVICE FOR CONCEALING OR DISPLAYING PRINTED MATTER

[76] Inventor: Claude Moreau, 8506 60th Ave., Elmhurst, N.Y. 11373

[21] Appl. No.: 505,825

[22] Filed: Jun. 20, 1983

[51] Int. Cl.[3] ..... A44C 3/00

[52] U.S. Cl. ..... 40/1.6; 40/116; 40/515; 446/72; 446/379

[58] Field of Search ..... 40/1.5, 1.6, 514, 516, 40/517, 116; 46/116, 135

[56] References Cited

U.S. PATENT DOCUMENTS

| | | | |
|---|---|---|---|
| 672,797 | 4/1901 | McCormack | 46/116 |
| 889,714 | 6/1908 | McDonald | 40/1.6 |
| 2,490,621 | 12/1949 | Colomer | 40/514 |
| 3,206,889 | 9/1965 | Ryan | 46/135 R |
| 3,293,783 | 12/1966 | Rosenfeld | 46/116 X |
| 3,711,976 | 1/1973 | Allen | 40/514 |
| 4,024,657 | 5/1977 | Dutcher | 46/135 R |

*Primary Examiner*—Gene Mancene
*Assistant Examiner*—Wenceslao J. Contreras
*Attorney, Agent, or Firm*—Hubbell, Cohen, Stiefel & Gross

[57] ABSTRACT

A toy or novelty item for selectively concealing or displaying advertisements, messages, slogans, logos, or artwork printed on a ribbon. The ribbon is rolled about a reel which is concealed in a compartment such as the head or body of a doll. The ribbon extends outward from an opening in the compartment. A string which is wound about the reel in the opposite sense to that of the ribbon extends outward from the compartment through another opening. If the ribbon is pulled outward to display the printed material, the string winds on the reel. On the other hand, if the string is pulled outward, the ribbon winds on the reel, thus concealing the printed material.

9 Claims, 4 Drawing Figures

FIG. 1
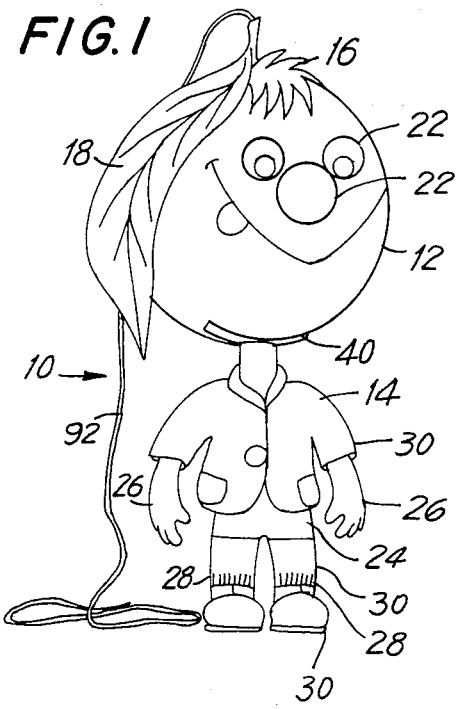
FIG. 2
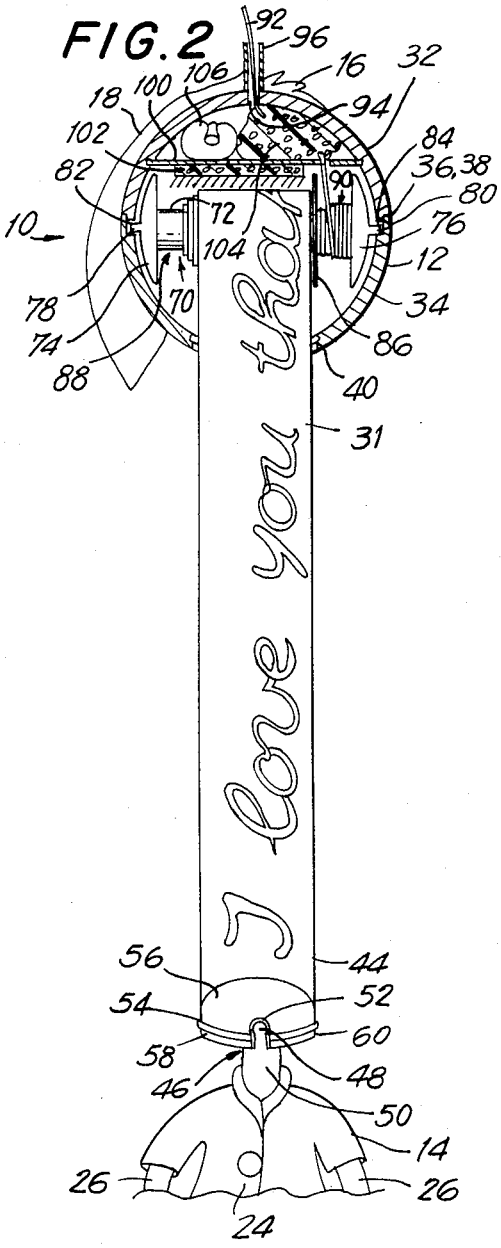
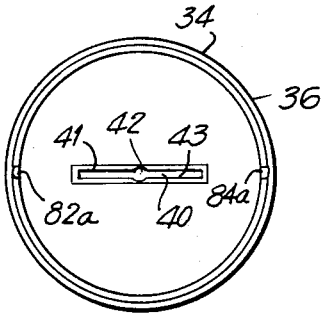
FIG. 3
FIG. 4
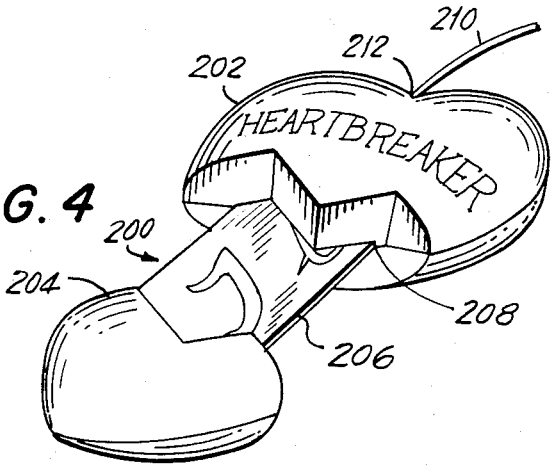

MECHANICAL DEVICE FOR CONCEALING OR DISPLAYING PRINTED MATTER

TECHNICAL FIELD

This invention relates to a mechanical device in the form of a toy or novelty item for selectively concealing or displaying material printed on a ribbon.

BACKGROUND OF THE INVENTION

There are many techniques currently in use for displaying advertisements, messages, slogans, logos or artwork. For instant visibility, such material may be printed on the surface of a novelty item or toy such as a doll. Such an approach often allows a marketer of particular goods or services to induce the consuming public to identify a particular slogan or logo with a particular doll or novelty item. Typically, the desired slogan or logo is printed on the shirt of a small doll. However, novelty items or toys such as dolls have only limited surface areas and thus only limited amounts of printed material can be displayed thereon.

Accordingly, it is an object of the present invention to develop a mechanical device in the form of a toy or novelty item for displaying printed material such as advertisements, messages, slogans, logos or artwork which does not suffer from the above-mentioned surface area limitation. Such a device permits marketers of goods and services to induce the consuming public to identify particular slogans or logos with particular characters in the form of dolls or particular shapes in the form of novelty items.

DISCLOSURE OF THE INVENTION

The present invention is a mechanical device, typically in the form of a toy or novelty item, for selectively concealing or displaying printed material, such as advertisements, messages, slogans, logos or artwork. The device comprises first and second separable body portions and a ribbon connecting the first and second body portions on which the printed material is displayed. In a typical embodiment of the invention, the first body portion may be the head of a doll and the second body portion may be the body of a doll including the doll's arms, legs and necks. Alternatively, the first and second body portions may be adjoining portions of a heart-shaped novelty item. The toy or novelty item for displaying printed material also includes a mechanism for winding and unwinding the ribbon. When the ribbon is wound, it is concealed in one of the body portions and the first and second body portions are adjacent one another, thereby forming the completed novelty item or toy. When the first and second body portions are separated from one another, the ribbon unwinds and the printed material is displayed.

When the toy or novelty item is in the form of a doll, the ribbon winding and unwinding mechanism may be located in either the head or the body of the doll. In a particular embodiment of the invention, the winding and unwinding mechanism comprises a rotatable reel which fits inside the head of the doll. Preferably, the reel is divided along its length into two winding zones. One end of the ribbon is attached to the first winding zone of the reel and is windable thereon. The ribbon extends from the first winding zone of the reel through a slot in the head of the doll to the neck portion of the body of the doll to which the other end of the ribbon is attached. Windable about the second winding zone of the reel is a string or similar medium. The string is wound about the reel in a sense opposite to that of the ribbon. Thus, if the ribbon is wound clockwise, the string is wound counterclockwise. The string extends outward from the head of the doll through an opening therein. When the ribbon is unwound from the reel by pulling on the body of the doll to enable display of the printed material, the string winds on the reel. To rewind the ribbon and conceal the printed material, one merely pulls on the string, thereby causing the string to unwind from the reel and the ribbon to wind onto the reel. When the ribbon is fully wound onto the reel, the head and body portions are adjacent one another thereby forming a complete doll.

The above-described mechanical device in the form of a toy or novelty item is a unique means for selectively concealing or displaying, partially or entirely, printed material. It has all the advantages of conventional toys, novelty items, and other promotional devices which are used to display advertisements, messages, slogans, logos or artwork. At the same time, the space available for the message is not limited to the surface area of the toy or novelty item. In addition, the method of operation by which printed material is displayed by separating the two body portions comprising a novelty item or toy and by which the printed material is concealed by pulling on a string to reconstitute the toy or novelty item is likely to focus attention on both the nature of the novelty item or toy and the material printed on the ribbon, thus making such a toy or novelty item highly attractive for advertising campaigns and the like.

BRIEF DESCRIPTION OF THE DRAWINGS

FIG. 1 shows a doll adapted for displaying printed material in accordance with an illustrative embodiment of the invention.

FIG. 2 schematically illustrates the ribbon winding and unwinding mechanism for the doll of FIG. 1 of the invention.

FIG. 3 is a top view of the bottom portion of the head of the doll of FIG. 1.

FIG. 4 shows a heart-shaped novelty item adapted for displaying printed material in accordance with an alternative illustrative embodiment of the present invention.

BEST MODE FOR CARRYING OUT THE INVENTION

Turning to the drawings, FIG. 1 shows a doll which is adapted to selectively display or conceal printed material such as an advertisement, message, slogan, logo or artwork. The doll 10 comprises two separable portions, the head 12 and body 14. The head 12 of the doll 10 includes specific decorative features which are designed to make the doll an easily recognizable and distinct character. Illustratively, such features includes hair 16, a leaf-like head covering 18 and distinctive facial features 22. The body of the doll includes torso 24, arms 26, and legs 28, all of which are covered at least in part by distinctively designed clothing 30.

As shown in FIG. 2, the head 12 and body 14 of the doll 10 are connected by a ribbon 31 which carries printed material. The head 12 of the doll 10 typically is formed from a pair of matching hemispheres 32, 34. Lower hemisphere 34 has a lip 36 which is receivable in a matching groove 38 formed in the upper hemisphere 32. The ribbon 31 extends outward from the interior of the head 12 through a slot 40 which is located at the bottom of the lower hemisphere 34. The slot 40 comprises side portions 41, 43 and a circular opening 42 between the side portions 41, 43.

At the lower end 44 of the ribbon 31 is a ball and socket type joint 46 which is used for attaching the ribbon 31 to the body 14 of the doll 10. The ball portion 48 of the joint 46 is formed integrally with the neck 50 of the body 14 of the doll. The groove portion 52 of the joint 46 is formed in an end piece 54 which is attached to end 44 of ribbon 31. Preferably, the ribbon 31 is attached to end piece 54 by being glued between two planar elements, one of which 56 is shown in FIG. 2. End piece 54 also includes a pair of identical strips 58 and 60 which are separated by the groove 52. When the ball 48 is inserted into the groove 52, the ball and socket joint 46 is formed. The joint 46 enables the body 14 of the doll 10 to rotate freely relative to the ribbon 31. The strips 58 and 60 and the ball 48 form a unit which snaps into the slot 40. The strips 58 and 60 fit into the side arm portions 41 and 43 of the slot and the ball 48 fits into the circular orifice 42 at the center of the slot.

The head 12 of the doll 10 includes a mechanism for winding and unwinding the ribbon 31. The mechanism comprises a reel 70 upon which the ribbon 31 is wound and from which the ribbon 31 is unwound. The reel 70 includes an axle 72 and two end pieces 74 and 76 located at either end of the axle 70. The end pieces 74 and 76 have protrusions 78 and 80 which are insertable into diametrically opposed generally circularly shaped openings 82 and 84. The bottom portions 82*a* and 84*a* of the openings 82 and 84 are formed in the lower hemisphere 34 while matching portions are formed in the upper hemisphere 32 so that circular openings 82 and 84 are formed when the hemispheres 32, 34 are joined to form head 12. A divider 86 is used to divide the reel into two winding zones 88 and 90. The first winding zone 88 is used for winding and unwinding the ribbon. The ribbon 31 extends from the first winding zone 88 of the reel 70 through the slot 40 in the head 12 of the doll 10 to the body 14 of the doll 10 to which it is connected as discussed above. The second winding zone 90 of the reel is used to wind a string 92. The string is wound in the opposite sense to that of the ribbon. Thus, if the ribbon is wound clockwise about the reel, the string is wound counterclockwise. The string extends outward from the head of the doll through an opening 94. A tubular member 96 located at this opening facilitates movement of the string into and out of the opening 94.

Operation of the doll 10 to selectively conceal or display the material printed on the ribbon 31 can be understood as follows. In the configuration of FIG. 1, the printed material is concealed, the ribbon 31 is fully wound on the reel 70 and the body and head portions of the doll are connected to one another to form a completed doll. The strips 58 and 60 of the endpiece unit 54 fit into the side arm portions 41 and 43 of the slot 40. The ball 48 fits into the circular orifice of the slot 42. In the configuration of FIG. 1, the head 12 of the doll 10 is free to rotate relative to the body 14.

To display the printed material, the body portion 14 is pulled away from the head 12. This causes the ribbon 31 to unwind from the reel and extend outward through slot 40. The string 92 simultaneously enters the head 12 of the doll 10 through opening 94 and is wound onto the winding zone 90 of the reel 70.

To cause the ribbon 31 to rewind on the reel 70, one merely pulls on the string 92. This causes the string to unwind from the reel 70 and extend outward through the opening 94, simultaneous with rewinding of the ribbon on axle 72 of the reel 70.

Extending across the interior of the head of the doll is a rigid wall 100. Illustratively, on the bottom surface of the wall 100 is a layer 102 of foam-like material such as polyurethane foam. The layer 102 is in contact with the ribbon 31 and causes the ribbon to wind tightly on the reel 70. On the upper surface of the wall 100 is a mass 104 of foam-like material such as polyurethane foam through which the string 92 passes while winding and unwinding from the reel. The mass 104 provides support for the string 11 so that the portion of the string 12 inside the head 12 of the doll 10 remains relatively taut. In addition, the head 12 of the doll 10 also includes a bell 106 to enable the doll 10 to emit a distinctive sound.

Referring to FIG. 4, there is shown an alternative embodiment of the invention. The device 200 comprises a pair of body portions 202, 204 which together form a heart-shaped novelty item. The body portions 202 and 204 are connected by a printed ribbon 206. The ribbon winding and unwinding mechanism of the type shown in FIG. 2 is located in body portion 202. The ribbon extends outward from body portion 202 through slot 208. A string 210 which extends outward from body portion 202 through opening 212 is used to rewind the ribbon 206 so that body portions 202 and 204 may be joined to form a heart-shaped novelty item.

It is to be understood that the above-described embodiments of the invention are intended to be illustrative only. For example: The string utilized to rewind the ribbon in the embodiment depicted in FIG. 2 may, within the scope of the present invention, be replaced by a coil spring to provide for automatic rewinding of the ribbon element. Numerous other embodiments of the invention may also be formulated by those skilled in the art without departing from the spirit or scope of the invention.

What is claimed is:

1. A mechanical device for selectively concealing or displaying printed material comprising:

first and second separable body portions, said first body portion having first and second openings;

a ribbon on which said material to be selectively concealed or displayed is printed and connected between said first and second body portions, said ribbon extending outward from inside said first body portion through said first opening to said second body portion; and ribbon winding and unwinding means for enabling the display of said printed material when said ribbon is unwound and for enabling said printed material to be concealed when said ribbon is wound, said ribbon winding and unwinding means comprising:

a rotatable reel on said first body portion and having first and second winding zones, said ribbon being connected at one end thereof to said reel and being windable from said first winding zone of said reel, and means extending outward from said first body portion through said second opening and windable onto and unwindable from said second winding zone of said reel for causing said ribbon to wind onto said reel when said means is being unwound from said reel, and said means being wound onto said reel when said ribbon is being unwound from said reel.

2. The device of claim 1 wherein said means is a string.

3. The device of claim 2 wherein said first body portion further includes means for enabling said ribbon to be wound tightly on said reel.

4. The device of claim 3 wherein said means for enabling said ribbon to be wound tightly on said reel comprises a rigid wall mounted adjacent said reel and a layer of foam-like material mounted on said wall, said layer of foam-like material being in contact with said ribbon.

5. The device of claim 3 wherein said first body portion further includes means within said first body portion for supporting the string.

6. The device of claim 5 wherein said means for supporting said string comprises a mass of foam-like material through which said string travels.

7. A mechanical device for selectively concealing or displaying printed material comprising:

a compartment having first and second openings;

a rotatable reel having first and second winding zones fitted inside said compartment;

a ribbon on which said material to be selectively concealed or displayed is printed, said ribbon being windable onto and unwindable from said first winding zone of said reel, first means for unwinding said ribbon from said reel and for pulling said ribbon out of said compartment through said first opening to display said printed material; and second means extending outward from said compartment through said second opening and windable onto and unwindable from said second winding zone of said reel for causing said ribbon to wind onto said reel when said second means is being unwound from said reel.

8. The device of claim 7 wherein said first means comprises a body portion attached to the ribbon.

9. The device of claim 8 wherein said second ribbon means comprises a string.

* * * * *